United States Patent [19]

Stahlke et al.

[11] 4,030,926

[45] June 21, 1977

[54] LIGHT-SENSITIVE MATERIAL CONTAINING A DYE-FORMING COMBINATION OF A HETEROCYCLIC COMPOUND AND A CYCLIC DIHALODICARBONYL COMPOUND IN A POLYMERIC BINDER

[75] Inventors: Kurt-Rainer Stahlke, Krefeld; Werner Krafft; Rudolf Meyer, both of Leverkusen; Hans Jürgen Rosenkranz, Krefeld, all of Germany

[73] Assignee: AGFA-Gevaert, A.G., Leverkusen, Germany

[22] Filed: July 7, 1975

[21] Appl. No.: 593,305

[30] Foreign Application Priority Data

July 11, 1974 Germany ..... 2433373

[52] U.S. Cl. ..... 96/90 R; 96/27 E; 252/301.35

[51] Int. Cl.[2] ..... G03C 1/52

[58] Field of Search ..... 96/90 R, 90 PC, 27 E; 252/301.35

[56] References Cited

UNITED STATES PATENTS

| | | | |
|---|---|---|---|
| 3,394,395 | 7/1968 | Mattor et al. | 96/90 R |
| 3,502,476 | 3/1970 | Itano et al. | 96/90 R |
| 3,671,239 | 6/1972 | Zweig | 96/90 R |
| 3,745,004 | 7/1973 | Zweig | 96/90 R |

*Primary Examiner*—Won H. Louie, Jr.
*Attorney, Agent, or Firm*—Connolly and Hutz

[57] ABSTRACT

A storage medium for optical data recording comprises a dye-forming combination which on exposure to light within a first range of wavelengths reacts irreversibly to form a dye, but is substantially insensitive to light within a second range of wavelengths which is capable of energizing the dye to produce luminescence. The dye-forming combination consists of a heterocyclic compound of the formula I and of a cyclic dihalodicarbonyl compound of the formula II

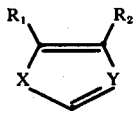

I

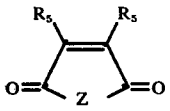

The symbols are defined in the specification. An example of formula I is benzofuran and an example of formula II is dibromomaleic anhydride.

5 Claims, No Drawings

LIGHT-SENSITIVE MATERIAL CONTAINING A DYE-FORMING COMBINATION OF A HETEROCYCLIC COMPOUND AND A CYCLIC DIHALODICARBONYL COMPOUND IN A POLYMERIC BINDER

This invention relates to a light-sensitive material, in particular one which is suitable for optical data storage, in which exposure to ultraviolet light within a first range of wavelengths produces a compound which when exposed to ultraviolet light within a second range of wavelengths can be energized to produce luminescence in the visible region of the spectrum.

Numerous processes are known in which light-sensitive organic substances can be used for recording images. Some of these processes are based on photochemical rearrangements or reactions of organic compounds resulting in a colour change. Such photochemical reactions of organic compounds have been comprehensively described e.g. in "Praparative organische Photochemie" (A. Schönberg, Springer Verlag 1958) and in "Light-sensitive Systems" (J. Kosar, John Wiley and Sons, New York, 1965).

Among these photochemical reactions may be included e.g. the formation of monoethine dyes when trihalomethylene compounds are subjected to photolysis in ultraviolet light in the presence of aromatic or heterocyclic compounds which by virtue of their constitution have CH ring members which are particularly reactive for condensation or diazo coupling reactions.

Also relevant in connection with such photochemical reactions are the photochromic spiropyran compounds which, on exposure to light, are reversibly converted into coloured compounds which can be stabilized by salt formation in the presence of so-called HX donors as described, for example, in German Offenlegungsschrift No. 2,243,146.

Lastly, there should also be mentioned the light-sensitive cyclic polyimides described in German Pat. No. 1,522,385, which are decomposed into dark coloured substances by the action of light.

The known light-sensitive systems have the disadvantage that they are either too insensitive, i.e. they require exposure to light of very high intensity for recording images; that the coloured compound formed by the action of light is not sufficiently stable but is reversibly reconverted into the colourless form or that the recordings produced by exposure to light require to be fixed because the recording materials are sensitive to the kind of light to which they are inevitably exposed in storage or when the stored information is read out.

It is an object of this invention to find, as far as possible, a simple light-sensitive material which can be processed dry and which is suitable in particular for optical data storage, which material is capable of recording information when exposed to light within a first range of wavelengths, which information then can be rendered visible by exposure to light within a second range of wavelengths (e.g. longer wavelengths).

The invention therefore provides a storage material for optical data recording comprising a combination capable of forming a dye which, when exposed to light within a first range of wavelengths, reacts irreversibly to form a dye and is substantially insensitive to exposure to light within a second range of wavelengths which is capable of bringing the dye to a state of luminescence, characterised in that the dye forming combination consists of a heterocyclic compound of the formula

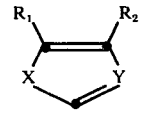

I in which

X represents oxygen, sulphur or the group N—$R_3$;

Y represents nitrogen or the group ≥ C—$R_4$;

$R_1$ and $R_2$, which may be the same or different, represent hydrogen or an alkyl or aryl group or may together represent the group required to complete a condensed benzene or naphthalene ring which may substituted;

$R_3$ represents hydrogen or an alkyl or aryl group and $R_4$ represents hydrogen or an alkyl group; and of a cyclic unsaturated dihalodicarbonyl compound of the formula

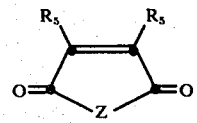

II in which

Z represents oxygen or the group > N—$R_6$ or

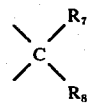

$R_5$ represents halogen, e.g. chlorine, bromine or iodine, $R_6$ represents hydrogen or an alkyl group and $R_7$ and $R_8$, which may be the same or different, represent hydrogen or an alkyl group.

Any alkyl group represented by any one of $R_1$, $R_2$, $R_3$, $R_4$, $R_6$, $R_7$ and $R_8$ may be substituted or unsubstituted alkyl group, in particular a lower alkyl group having up to 5 carbon atoms, for example methyl, ethyl, isopropyl; examples of substituted alkyl groups are cyanomethyl and aralkyl, such as benzyl (=phenylmethyl).

Any aryl group represented by any one of $R_1$, $R_2$ and $R_3$ may be a substituted or unsubstituted aryl group and preferably a phenyl group.

Suitable heterocyclic compounds of the formula (I) include e.g. furan, thiophene, benzofuran, benzothiophene, benzimidazole, 3-methylbenzofuran, N-phenylbenzimidazole, 4,5-diphenylimidazole, 4-nitrobenzimidazole, 4-chlorobenzimidazole, naphtho-[2,3-d]imidazole, 5-chlorobenzofuran, 3,4-dimethylfuran, furyl-2-acetonitrile, and 2-phenylfuran. Particularly suitable heterocyclic compounds of the formula (I) are those in which X represents an oxygen atom and Y a CH group, e.g. a furan or benzofuran which may be substituted.

Particularly suitable cyclic dihalodicarbonyl compounds (II) are the cyclic derivatives, in particular the anhydrides and cyclic imides of dihalomaleic acid, the halogen, $R_5$ preferably being bromine.

The optical data storage material according to the invention contains the two reaction components I and II in a layer of binder comprising a film forming hydrophobic polymer. The light-sensitive layer of the optical data storage material according to the invention may either be self-supporting or mounted on a conventional transparent or opaque support layer. Suitable support layers include e.g. films of cellulose esters, polyesters such as polyethyleneterephthalate, polycarbonate or other film-forming polymers.

Suitable binders for the ultraviolet sensitive layer of the optical data storage material according to the invention include homopolymers and copolymers of monomers which have copolymerisable olefinic double bonds, e.g. vinyl esters such as vinyl acetate, vinyl chloride, vinylidene chloride, styrene, (meth)acrylic esters, (meth)acrylamides and acrylonitrile; polyvinyl acetales such as polyvinyl butyral or formal, and cellulose esters such as cellulose acetate butyral and cellulose alkylsuccinate.

High molecular weight homopolymers and copolymers of acrylic and methacrylic acid esters with aliphatic or cycloaliphatic alcohols which contain 1 to 8 carbon atoms, preferably aliphatic alcohols containing 1 to 4 carbon atoms, have been found to be particularly suitable. Among these, polymethylmethacrylate may be particularly mentioned. To the last mentioned (meth)acrylic acid ester polymers there may, if desired, also be added other polymers with stepwise graded polarity, e.g. polyacrylamide or polycarbonate. It is preferred to use binders in which the intrinsic absorption is substantially below 250 nm.

The total quantity of reactants (I + II) contained in the radiation sensitive layer of the optical data storage material according to the invention is not critical and may vary within wide limits, e.g. between 3 and 50 percent by weight, based on the binder. The upper limit is determined, of course, by the absorption capacity of the binder for the reactants and the lower limit is determined by the fact that a certain minimum density of fluorescence must be produced for legibility. The heterocyclic compound I, e.g. benzofuran, is suitably used in at least double the molar quantity, for example 2 to 4 times the molar quantity, based on the cyclic compound II, e.g. dibromomaleic acid anhydride.

It has also been found suitable to add to the radiation sensitive layer, minor quantities (about 0.2 to 5 percent by weight, based on the light-sensitive layer) of a compound which has the triplet energy greater than 55 kilocalories per mol. Such compounds evidently act as sensitizers for the photochemical reaction. Examples of such sensitizers include diacetyl, benzophenone and acetophenone.

The sensitivity can also be increased by the addition of photoinitiators such as benzoin isopropyl ether or bromoform as well as polar compounds such as dimethylsulphoxide, which may be added in combination with polyethylene glycol.

The optical data storage material according to the invention has a sensitivity to ultraviolet light within a first range of very short wavelengths with a maximum between about 200 and 310 nm. The sensitivity decreases towards the region of longer wavelengths and is negligible above 350 nm. This sensitivity range is obviously associated with the energy difference between the basic state of the cyclic dihalogen compound II and the state in which it is optically energised. The dye formed in the reaction, on the other hand, has an absorption maximum at wavelengths above 350 nm, i.e. in the region of longwave ultraviolet light. By exposure to ultraviolet light within this second range of wavelengths, e.g. light of 390 nm, the dye is energized to a luminescence which has an emission maximum between about 440 and 660 nm.

The stored information therefore becomes visible in the form of a luminescence image when exposed to light of 390 nm.

Since the optical data storage material according to the invention is substantially insensitive to light in the region of 390 nm, there is no risk of re-exposure of the previously exposed portion of the data storage material if the light used for producing luminescence (the reading light) is suitably selected. Fixing to render the unexposed areas of the layer insensitive to light is therefore unnecessary. The material according to the invention retains its original sensitivity in the unexposed areas and additional information can therefore be recorded after the first recording by one or more subsequent exposures to ultraviolet light within the first range of wavelengths.

Light-dark contrasts of 15 to 25 can be achieved with the optical data storage material according to the invention. Such a range of contrasts corresponds to a logarithmic brightness range of $\Delta D = 1.2$ to 1.4. Although the material according to the invention is primarily suitable for digital recording, half-tone images can also be produced with suitable choice of the light used for recording.

To record the information, the optical data storage material according to the invention is exposed imagewise to ultraviolet light within the first range of wavelengths, e.g. by means of a high pressure mercury vapour lamp. This exposure may be carried out in contact with an original copy, the material being exposed either directly through the original or by reflection of light from the original. Exposure to light by projection is also possible. Exposure need not be carried out simultaneously over a wide area but may be carried out successively, for example the material may be exposed to a suitable source of ultraviolet light through a point or slit aperture which scans the original, line by line. The material according to the invention is suitable in particular for digital recording, using a focussed ultraviolet laser beam which is modulated according to the information. Suitable ultraviolet light for digital recording is obtained, for example, by doubling the frequency of $Ar^+$ laser light (Wiss. Ber. AEG-TELEFUNKEN 42, (1969) page 13).

It is found to be of particular advantage that the light sensitive compounds are present in molecular distribution in the material according to the invention. The recording layer therefore operates without a grain, e.g. it has a very high power of resolution and hence a very high storage density.

Not only the recording of the information but also the reading of it, can be carried out simultaneously or successively, depending on whether the recording layer is energized to luminescence either simultaneously over a wide area or successively by line-by-line scanning by means of suitable ultraviolet light within the second range of wavelengths. For this purpose a laser beam may again be used, e.g. the emission radiation of certain noble gas lasers such as $Ar^+$ or $Kr^+$ lasers.

EXAMPLE 1

A solution of the following composition is cast on a 100 $\mu$ thick polyethylene terephthalate film substrate by the immersion process:

15 g of polymethylmethacrylate,
67.5 ml of chloroform,
37.5 ml of ethylene chloride,
2.9 g of dibromomaleic acid anhydride and
3.15 g of benzofuran.

The solution is prepared by dissolving 15 g of polymethylmetharylate in a mixture of 45 ml of chloroform and 37.5 ml of ethylene chloride. A solution of 2.9 g of dibromomaleic acid anhydride and 3.15 g of benzofuran in 22.5 ml of chloroform is then added to this solution.

A transparent layer about 18 $\mu$ in thickness is obtained. When this layer is exposed through a stencil with a mercury vapour lamp manufactured by the firm Hanau, a recording is obtained which is seen as a powerful flourescence at 480 to 660 nm in the exposed areas when the layer is energized to fluorescence by exposure to ultraviolet light of about 380 nm. The more powerful the light to which the layer was originally exposed, the more intense is the emission of fluorescent light.

EXAMPLE 2

A solution of the following composition is cast on a polyethylene terephthalate film substrate, 100 $\mu$ in thickness, as in Example 1:

15 g of polymethylmethacrylate,
45 ml of chloroform,
37.5 ml of ethylene chloride,
22.5 ml of dioxane,
0.96 g of dibromomaleic imide and
1.05 g of benzofuran.

The casting solution is prepared by dissolving dibromomaleic imide and benzofuran successively in 22.5 ml of dioxane and adding the resulting solution to a solution of the binder in chloroform/ethylene chloride.

The solution is appled by the immersion process and a transparent layer of about 18 $\mu$ is obtained. When this layer is exposed as in Example 1, a fluorescent image (emission at 440 to 660 nm) is obtained in the exposed areas when the layer is energized by exposure to light of about 390 nm. The maximum intrinsic sensitivity of the unexposed layer is about 250 nm. The intrinsic sensitivity is negligible in the region of the wavelengths of light used to energize the layer to produce fluorescent light so that no accidental re-exposure occurs when the stored information is scanned and read out, and consequently the original contrast between light and dark areas is preserved. This means that the image or digital recording on the film need not be stabilized or fixed.

EXAMPLE 3

If ultraviolet sensitive layers of the type described in Example 2 are prepared but the concentration of dibromomaleic imide is increased to 2.9 g and that of benzofuran to 3.15 g while the proportions by weight are kept the same, the luminescence obtained with the same duration and intensity of exposure is more intensive than in Example 2.

EXAMPLE 4

A solution of the following composition is cast on a polyethylene terephthalate film substrate as described in Example 1:

10 g of polystyrene (molecular weight about 100,000),
30 ml of chloroform,
25 ml of ethylene chloride,
0.64 g of dibromomaleic acid imide,
0.8 g of 3-methyl-benzofuran and
0.6 ml of silicone oil PN 200 (10% dissolved in chloroform). PN 200 is a poly(phenylmethyl)siloxane; Trade product of Bayer AG Leverkusen.

When the resulting transparent layer is exposed as in Example 1, a fluorescent image is obtained in the exposed areas when the layer is subsequently exposed to ultraviolet light of wavelength 400 nm. The wavelength of the fluorescent light and its intensity correspond to the results obtained in Example 2.

We claim:

1. A light sensitive storage material for optical data recording comprising in a supported or self-supporting layer comprised of a polymeric hydrophobic binder selected from the group consisting of homopolymers and copolymers of monomers which have copolymerizable olefinic double bonds, polyvinyl acetals and cellulose esters and a dye-forming combination of a heterocyclic compound of the formula

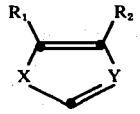

I

X represents oxygen, sulfur or the group >N—$R_3$,
Y represents nitrogen or the group ≥ C—$R_4$,
$R_1$ and $R_2$, which may be the same or different represent hydrogen or an alkyl or aryl group of may together represent the group required for completing a condensed benzene or naphthalene ring which may be substituted,
$R_3$ represents hydrogen or an alkyl or aryl group and
$R_4$ represents hydrogen or an alkyl group; and of a cyclic dihalodicarbonyl compound of the formula

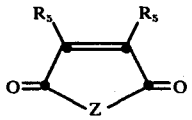

II in which
Z represents oxygen or the group >N—$R_6$ or

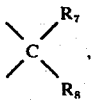

$R_5$ represents chlorine or bromine,
$R_6$ represents hydrogen or an alkyl group and
$R_7$ and $R_8$, which may be the same or different represent hydrogen or an alkyl group said heterocyclic compound of formula I and said cyclic dihalodicarbonyl compound of formula II being in amounts effective to provide said dye-forming combination upon exposure to ultraviolet light in a first range of wavelengths with capability of forming an image which is in a state of luminescence upon exposure to ultraviolet light in a second range of wavelengths not including said first range, and in a proportion of said heterocyclic compound of formula I being in at least double the molar quantity of the compound of formula II.

2. Storage material according to claim 1, characterised in that the heterocyclic compound of formula I contained in it is benzofuran.

3. Storage material according to claim 1, characterised in that the cyclic dihalodicarbonyl compound contained in it is dibromomaleic acid anhydride or dibromomaleic acid imide.

4. Storage material according to claim 1, characterised in that it contains, as binder for the dye forming combination of formulas I and II, a homopolymer or copolymer of methacrylic acid alkyl esters in which the alkyl group contains 1 to 4 carbon atoms.

5. Storage material according to claim 4, characterised in that it contains polyacrylamide or polycarbonate as additional binder.

* * * * *